US005947469A

United States Patent [19]

Henn et al.

[11] Patent Number: 5,947,469

[45] Date of Patent: Sep. 7, 1999

[54] DEVICE FOR LATERALLY ALIGNING SHEETS IN A FEEDER OF A SHEET-FED ROTARY PRINTING PRESS

[75] Inventors: Andreas Henn, Neckargemünd; Joachim Herrmann, Mannheim; Michael Seydel, Eppelheim, all of Germany

[73] Assignee: Heidelberger Druckmaschinen AG, Heidelberg, Germany

[21] Appl. No.: 08/679,380

[22] Filed: Jul. 8, 1996

[30] Foreign Application Priority Data

Jul. 8, 1995 [DE] Germany ..... 195 24 891

[51] Int. Cl.[6] ..... B65H 7/02

[52] U.S. Cl. ..... 271/228; 271/246; 271/254; 271/277; 101/410

[58] Field of Search ..... 271/227, 228, 271/245–247, 253–254, 277; 101/408–410

[56] References Cited

U.S. PATENT DOCUMENTS

| | | | |
|---|---|---|---|
| 3,743,277 | 7/1973 | Bolza-Schünemann et al. . | |
| 3,985,074 | 10/1976 | Bonsch | 271/277 X |
| 4,702,469 | 10/1987 | Jeschke et al. | 271/227 |
| 4,833,989 | 5/1989 | Wieland . | |

FOREIGN PATENT DOCUMENTS

| | | |
|---|---|---|
| 2 046 602 | 6/1972 | Germany . |
| 24 60 747 | 7/1976 | Germany . |
| 22 20 625 | 10/1976 | Germany . |
| 28 08 528 | 9/1979 | Germany . |
| 36 44 431 A1 | 9/1988 | Germany . |
| 42 30 894 | 1/1994 | Germany . |

*Primary Examiner*—Boris Milef

*Attorney, Agent, or Firm*—Herbert L. Lerner; Laurence A. Greenberg

[57] ABSTRACT

Device for laterally aligning sheets in a feeder of a sheet-fed rotary printing press wherein sheets having respective leading edges aligned at front lays of a feeder table are gripped by a gripper system of a pregripper in succession individually at an edge region thereof, and transferred with a swivelling or revolving movement to a gripper system of a revolvingly driven feed cylinder, includes motorized adjustment elements for laterally displacing at least one of the gripper systems transversely to sheet travel through the printing press, measuring elements for determining an actual position of a side edge of a respective sheet on the feeder table, and a setpoint- actual value comparator for comparing a setpoint position of the side edge of the respective sheet on the feeder table with the actual position of the side edge determined by the measuring elements, and for generating pulses for controlling the measuring elements in accordance with the comparison.

4 Claims, 4 Drawing Sheets

1
2
3
4
5
6
7
8
9
10
11
12
13
14
15

6
20
21
14
22
23
19
12
16
17
18
11
24

DEVICE FOR LATERALLY ALIGNING SHEETS IN A FEEDER OF A SHEET-FED ROTARY PRINTING PRESS

BACKGROUND OF THE INVENTION

1. Field of the Invention

The invention relates to a device for laterally aligning sheets in a feeder of a sheet-fed rotary printing press and, more particularly, such a printing press wherein sheets having respective leading edges aligned at front lays of a feeder table are gripped by a gripper system of a pregripper in succession individually at an edge region thereof, and transferred with a swivelling or revolving movement to a gripper system of a revolvingly driven feed cylinder 2. Description of the Related Art A device of this general type has become known heretofore from the published, non-prosecuted European Patent Application 0 120 348, wherein an aligning cylinder is disposed between the feeder table and a pregripper cylinder to which the sheet to be aligned is fed over the feeder table. At least two rows of front lays are disposed in the aligning cylinder symmetrically with the circumference thereof and have pull strips assigned for aligning the lateral edges of the sheets, the sheets being guided by grippers until the sheets are taken over in-register by a farther-guiding transporter The necessary leading-edge alignment as well as the tight gripping of the sheet during the lateral alignment thereof increases the alignment accuracy. When the sheets are shingled or stream-fed, a reduction in the shingle spacing or overlap is allowed or enabled The technical expense or effort required for achieving this advantage is very great, however.

An electronic device for controlling the position of the sheets on the cylinder of a printing press is disclosed in the published German Patent Document DE 41 13 478 A1. Scanning elements of CCD lines and a light source determine the position of the leading edge of the sheet in order to ensure an in-register sheet transfer. Mainly bent or creased leading edges of sheets are supposed to be detected thereby so as to correct possible errors by varying the printing parameters. This heretofore known publication mentions that, by this control of the sheet position, it is possible to hold the leading edge of the sheet in the gripper system of every printing unit so as to detect position variations during sheet transfer between the printing units or within a respective printing unit.

SUMMARY OF THE INVENTION

It is accordingly an object of the invention to provide a device for laterally aligning sheets in a feeder of a sheet-fed rotary printing press, which overcomes the aforementioned disadvantages of the heretofore-known devices and methods of this general type and which minimizes, by means of reliable operating equipment and at least possible expense, any problems which may arise due to a faulty lateral sheet alignment and, thereby, also allows or enables higher press speeds for increasing printing capacity.

With the foregoing and other objects in view, there is thus provided, in accordance with the invention, a device for laterally aligning sheets in a feeder of a sheet-fed rotary printing press wherein sheets having respective leading edges aligned at front lays of a feeder table are gripped by a gripper system of a pregripper in succession individually at an edge region thereof, and transferred with a swivelling or revolving movement to a gripper system of a revolvingly driven feed cylinder, comprising motorized adjustment elements for laterally displacing at least one of the gripper systems transversely to sheet travel through the printing press, measuring elements for determining an actual position of a side edge of a respective sheet on the feeder table, and a set-point-actual value comparator for comparing a setpoint position of the side edge of the respective sheet on the feeder table with the actual position of the side edge determined by the measuring elements, and for generating pulses for controlling the measuring elements in accordance with the comparison In accordance with another feature of the invention, the gripper system of the feed cylinder is formed of a gripper bar and sheet grippers secured thereon, and is so disposed on the feed cylinder as to be axially displaceable thereon.

In accordance with a further feature of the invention, the axially displaceable gripper bar is simultaneously adjustable radially to the axis of the feed cylinder.

In accordance with an added feature of the invention, the feed cylinder with the gripper system is axially displaceable.

In accordance with an additional feature of the invention, the gripper system of the pregripper is disposed so as to be laterally displaceable.

In accordance with yet another feature of the invention, the adjusting elements connected to the one laterally displaceable gripper system are linearly operative.

In accordance with yet a further feature of the invention, the adjusting elements include an element of a group thereof consisting of an actuator, a piezoelectric element and an electric linear motor.

In accordance with yet an added feature of the invention, the feed cylinder is formed with a cylinder gap having a defining side wall, and including linear guide rails which are secured to the side wall of the cylinder gap are included, the gripper bar being disposed so as to be axially displaceable in the guide rails.

In accordance with a concomitant feature of the invention, the feed cylinder in its entirety is supported so as to be displaceable with the gripper system thereof for correcting a faulty position of a side edge of a respective sheet.

The lateral alignment of the sheets can be effected by a lateral displacement of the gripper system of the pregripper or by a lateral displacement of both the gripper system of the pregripper, as well as the gripper system of a feed cylinder. Preferably, an axially displaceable arrangement of a gripper system formed of a gripper bar with sheet grippers secured thereto is disposed in a cylinder gap formed in a feed cylinder, because this produces a better processing of the measurement values in the control program for actuating or operating the adjusting elements for the axial displacement and more time for the lateral displacement of the gripper system. Particular details for constructing an embodiment of the invention are provided in description following hereinafter In contrast with the state of the art, an improvement in lateral sheet alignment has been provided in a relatively simple manner in accordance with the invention, and a considerable saving in time has been achieved for the lateral sheet alignment with great reliability for the precision or accuracy of the alignment. A pulling device of conventional type is no longer required. The feeder table can thus have a smooth surface, so that no locations at which the sheet may be tripped or caught, such as screw-heads, bellows or the like exist. Suction belts or tapes are able to be extended up to the front lays, so that front-lay blowers or fans an possibly also an overlay rake or buckle guide can be dispensed with.

For the circumferential alignment of the sheets, time is saved by the elimination of the pulling process, because the elimination of the pulling device permits the formation of shorter shingle spacing or ovelap of the sheet stream than heretofore permissible. This permits an increase in the press speed with reliable paper travel and high circumferential register quality, which is no longer influenced or affected by the lateral alignment of the sheets. Makeready times for the press are also able to be reduced, because adjustment of pull lays and blast air, and possibly also of an overlay rake or buckle guide, are eliminated.

Other features which are considered as characteristic for the invention are set forth in the appended claims. Although the invention is illustrated and described herein as embodied in a device for laterally aligning sheets in a feeder of a sheet-fed rotary printing press, it is nevertheless not intended to be limited to the details shown, since various modifications and structural changes may be made therein without departing from the spirit of the invention and within the scope and range of equivalents of the claims.

The construction of the inventions however, together with additional objects and advantages thereof will be best understood from the following description of the specific embodiment when read in connection with the accompanying drawings, wherein:

DESCRIPTION OF THE PREFERRED EMBODIMENTS

Figure 1:
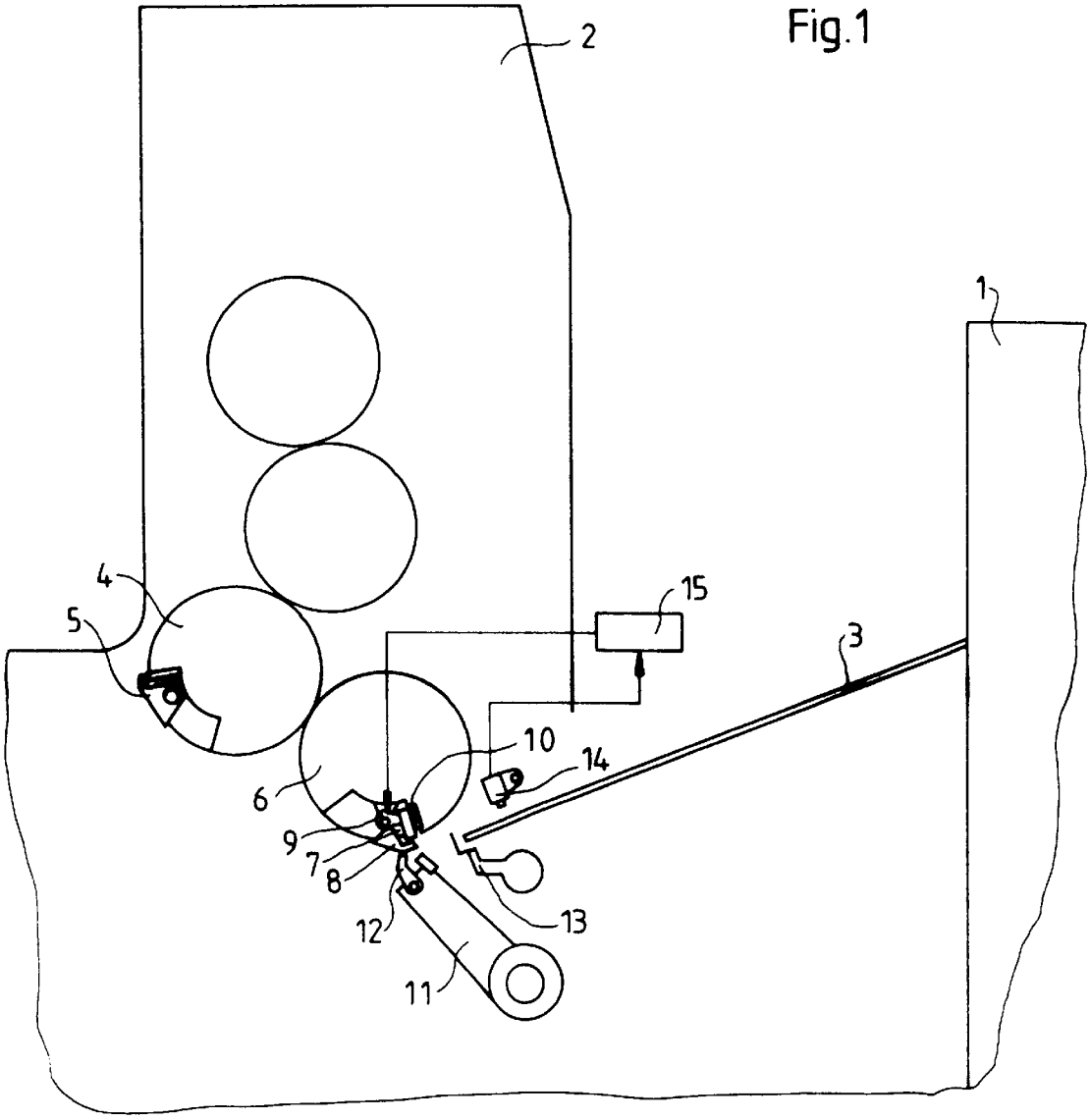
FIG. 1 is a fragmentary diagrammatic and schematic side elevational view of a sheet-fed rotary printing press incorporating the device according to the invention and elements for effecting a sheet transfer from a sheet feeder to a first printing unit.
Figure 2:
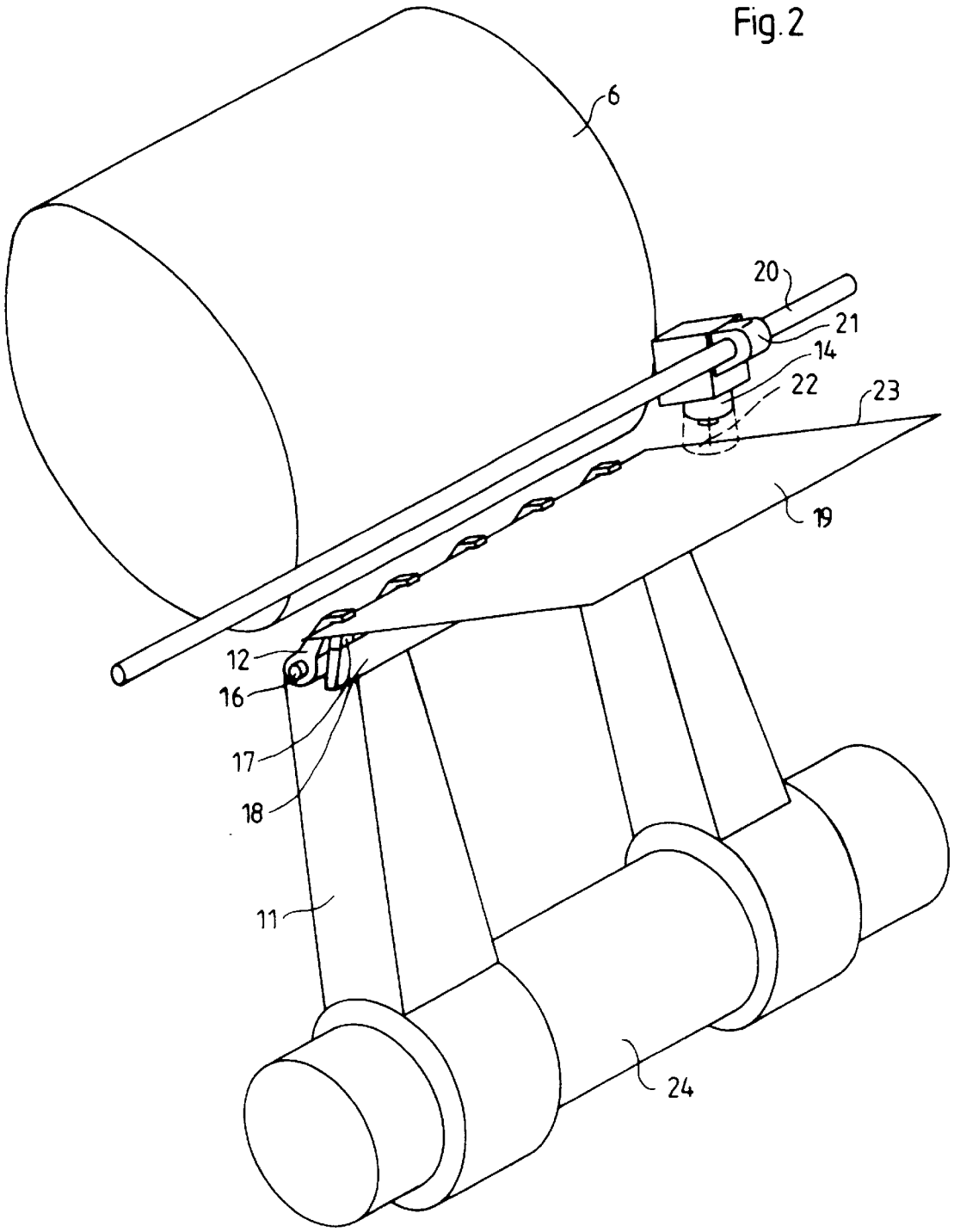
FIG. 2 is a much-enlarged fragmentary perspective view of FIG. 1 showing a pregripper and a feeder cylinder thereof in greater detail.
Figure 3:
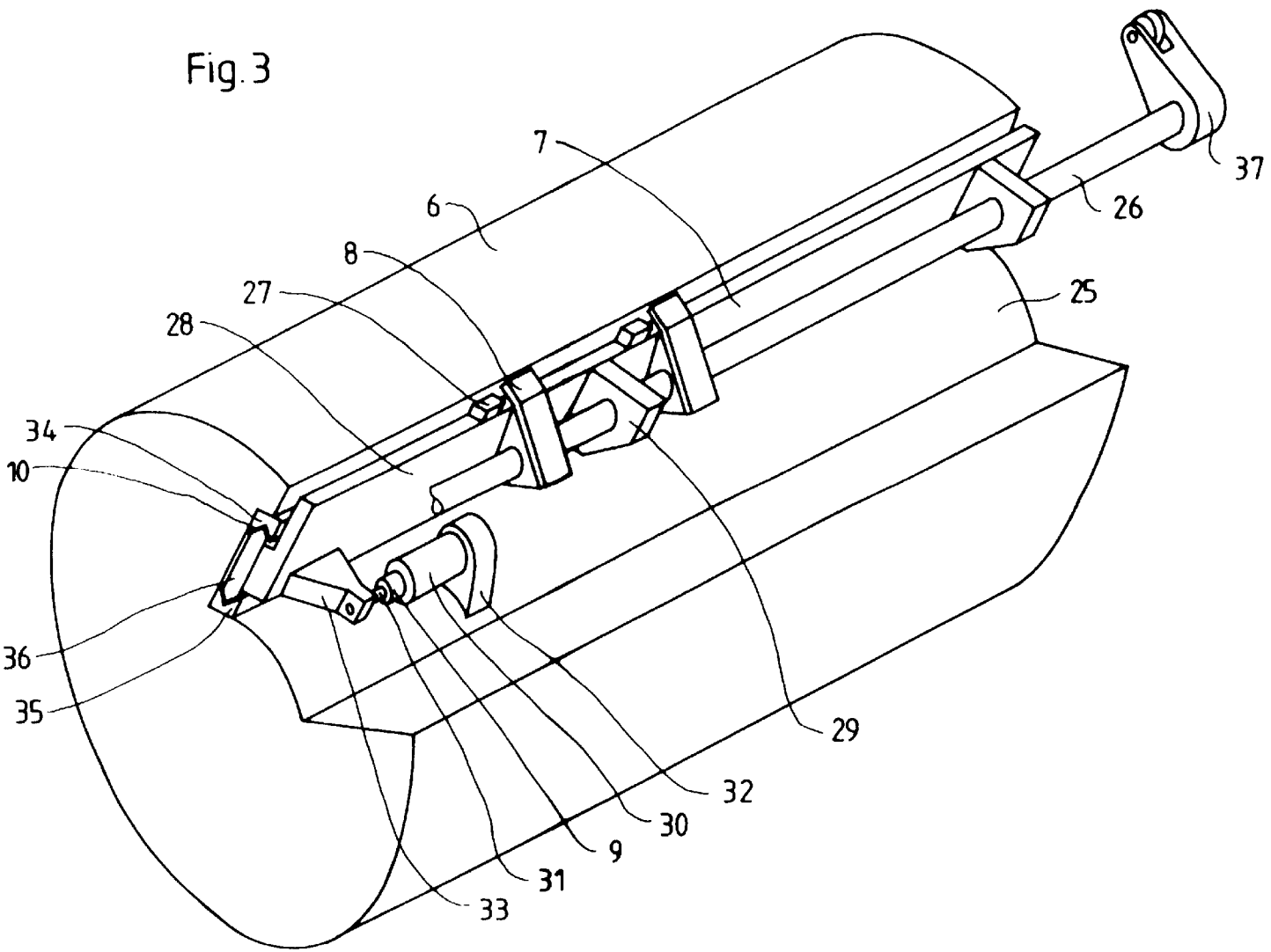
FIGS. 3 and 4 are much-enlarged additional fragmentary perspective view of FIG. 1 showing the feeder cylinder and a gripper system disposed in a cylinder gap thereof.
Figure 4:
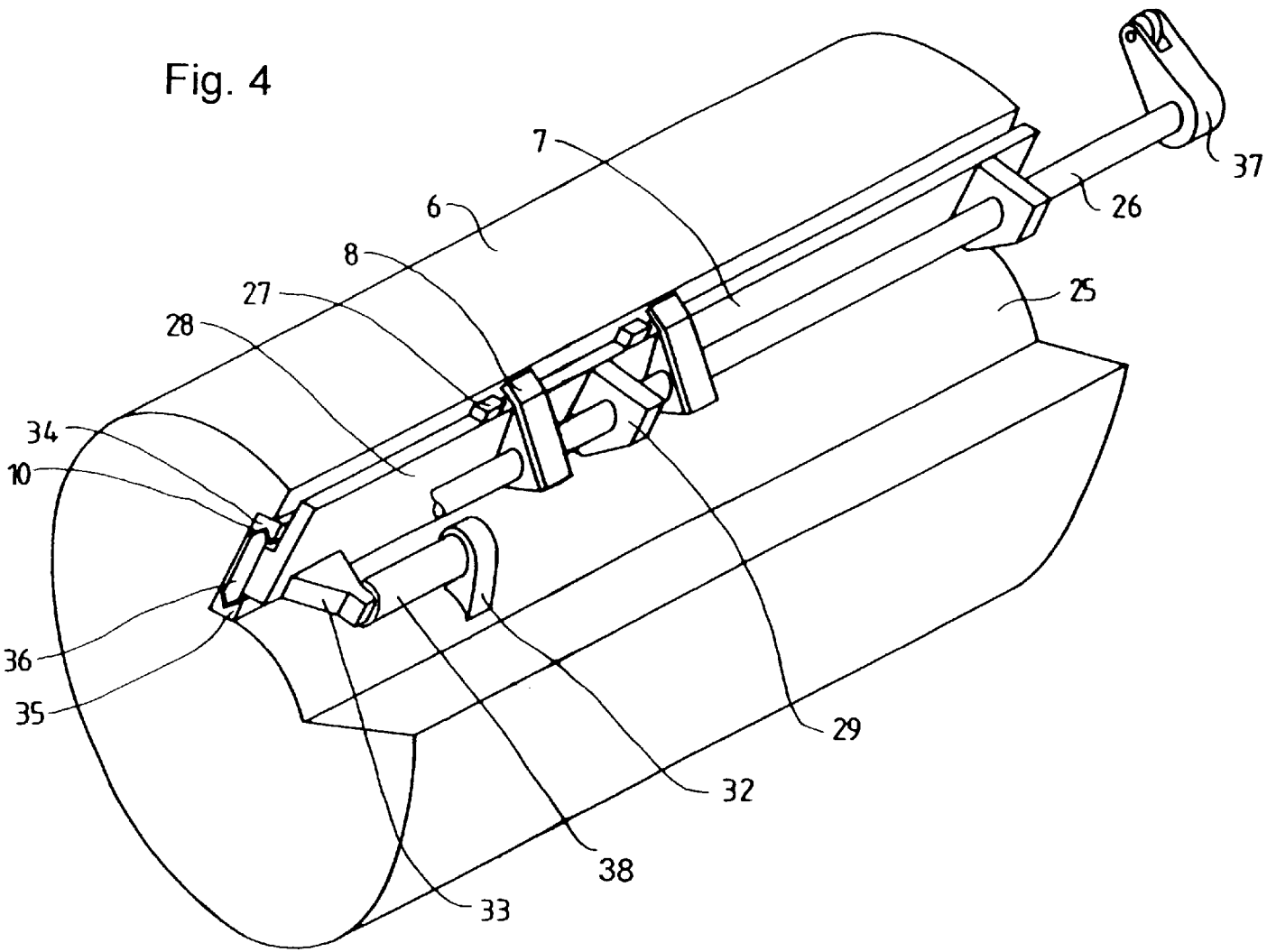

Referring now to the figures of the drawing in detail and first, particularly, to FIG. 1 thereof, there is shown therein a sheet feeder 1 from which sheets to be printed are fed over a feeder table 3 via a pregripper 11 and a feed cylinder 6 to an impression cylinder 4 of a first printing unit 2. The sheets arrive on the feeder table 3 with the leading edges thereof extending in a sheet transport direction and abutting front lays 13 for aligning the respective leading edges. An opto-electronic sensor 14 with an integrated illumination system determines the actual position of at least one lateral edge of the respective sheets and transmits this measured value to a conventional setpoint-actual value comparator in a control 15. In accordance with the representation shown in FIG. 2, sheet grippers 12 grip the leading edge of a respective sheet 19 aligned with the front lays 13, so that the sheet 19 is reliably held between the sheet grippers 12 and gripper seats 17 on a gripper seating ledge 18. When the front lays 13 are swung away from the feeder table 3, the sheet 19 is transferred by the pregripper 11, with a swivelling movement about the axis of a pregripper shaft 24, from the feeder table 3 to the gripper system of the feed cylinder 6. According to the exemplary embodiment shown in FIG. 3, this gripper system is also formed of a gripper bar 7 with sheet grippers 8 fastened thereon, the gripper system being mounted so as to be axially displaceable in a cylinder gap 25 formed in the feed cylinder 6. A gripper seating ledge 28 whereon gripper seats 27 for the sheet grippers 8 are formed is secured to a linearly guiding carriage 36 which is displaceable in linear guide rails 34 fastened to a side wall defining the cylinder gap 25. At the end of a gripper shaft 26, a cam-controlled roller lever 37 is provided for opening and closing the sheet grippers 8. Axial adjustment of the gripper bar 7 formed by the gripper seating ledge 28 is effected by a piezoelectric element 38 (schematically shown in FIG. 4) or a linear motor 9. The linear motor 9 disposed in a linear motor is housing 30 which is supported in a motor mount 32 at the bottom of the cylinder gap 25. A linear motor tappet 31 of the linear motor 9 is connected to a connecting element 33 which is secured to the gripper seating ledge 28. The linear motor receives control pulses which result from the setpoint-actual value comparison performed, in accordance with a prescribed conventional computer program in the control 15. In accordance with the deviation of the actual side edge position of the sheet on the feeder table 3 from the setpoint position thereof, an axial displacement of the gripper bar 7 in the cylinder gap 25 of the feed cylinder 6 is thus effected via the control 15, so as to correct the faulty side edge position of the sheet.

Such a correction of the side edge position of the sheet is also possible through the gripper system of the pregripper 11, so that, in this case, the gripper bar 7 formed by the gripper seating ledge 18 is axially displaced with the sheet grippers 12 secured thereon. The axial displacement may be effected in a guide on the arms of the pregripper 11, as well as by displacing the gripper shaft 26. Similarly, an axial displacement of the entire feed cylinder 6 with the gripper system thereof for correcting a faulty side edge position is also possible. Especially in the case of smaller feed cylinders, it may be better if the entire feed cylinder is displaced for the purpose of correcting a faulty position of the side edge of a sheet while utilizing any or all of the foregoing features of the invention

We claim:

1. Device for laterally aligning sheets in a sheet-fed rotary printing press, comprising:

a feeder table for receiving a sheet;

measuring elements for determining an actual position of a side edge of the sheet on said feeder table;

a setpoint-actual value comparator connected to said measuring elements for comparing a setpoint position of the side edge of the sheet with the actual position of the side edge of the sheet determined by said measuring elements;

a feed cylinder having a cylinder axis and having a cylinder gap formed therein;

linear guide rails disposed in said cylinder gap;

a gripper system displaceable parallel to the cylinder axis along said linear guide rails; and at least one electrically controllable linear actuator supported in said cylinder gap for axially displacing said gripper system in response to a comparison of the setpoint position with the actual position determined by said measuring elements.

2. Device according to claim 1, wherein the gripper system of the feed cylinder is formed of a gripper bar and sheet grippers secured thereon.

3. The device according to claim 1, wherein said electrically controllable linear actuator is a linear motor.

4. The device according to claim 1, wherein said electrically controllable linear actuator is a piezoelectric element.

* * * * *